United States Patent [19]

Flamm

[11] 4,234,228

[45] Nov. 18, 1980

[54] MODULAR ARTICULATING SEATING SYSTEM FOR THE HANDICAPPED

[76] Inventor: Jonathan A. Flamm, 1174 N. Curson St., #7, Los Angeles, Calif. 90046

[21] Appl. No.: 936,812

[22] Filed: Aug. 25, 1978

[51] Int. Cl.[3] ..... A47C 31/00; A62B 35/00

[52] U.S. Cl. ..... 297/464; 297/DIG. 4; 297/466; 297/486

[58] Field of Search ..... 297/DIG. 6, DIG. 4, 297/384, 284, 408, 353, 464, 466, 486

[56] References Cited

U.S. PATENT DOCUMENTS

| | | | |
|---|---|---|---|
| 3,424,493 | 1/1969 | Gottfried et al. | 297/384 |
| 3,897,104 | 7/1975 | Black | 297/353 |
| 3,934,934 | 1/1976 | Farrel, Jr. et al. | 297/384 |
| 3,950,026 | 4/1976 | Van Seenus | 297/464 |
| 3,992,057 | 11/1976 | Studebaker | 297/384 |
| 4,007,962 | 2/1977 | Muller-Deisig | 297/408 X |
| 4,047,755 | 9/1977 | McDonald et al. | 297/464 X |
| 4,054,319 | 10/1977 | Fogg, Jr. et al. | 297/466 |

FOREIGN PATENT DOCUMENTS

| | | | |
|---|---|---|---|
| 1238617 | 4/1967 | Fed. Rep. of Germany | 297/384 |
| 1809826 | 7/1969 | Fed. Rep. of Germany | 297/284 |
| 2001415 | 11/1971 | Fed. Rep. of Germany | 297/384 |
| 2150525 | 3/1972 | Fed. Rep. of Germany | 297/DIG. 4 |
| 1173209 | 7/1967 | United Kingdom | 297/284 |
| 1399285 | 7/1975 | United Kingdom | 297/384 |

*Primary Examiner*—James T. McCall
*Attorney, Agent, or Firm*—Freilich, Hornbaker, Wasserman, Rosen & Fernandez

[57] ABSTRACT

A seating system which can be adapted to the particular body size and required spatial orientation of a disabled person to hold him securely and in an orthopedically correct required position, and which can be fitted to any patient in a manner that minimizes the amount of custom craft work and cost. The seat includes a frame having three shells, including a lower seat back shell that can pivot and shift relative to the seat bottom shell and the upper back shell. A cushion system which includes a group of individual cushions can be rapidly installed on the shells to closely fit the individual. The shells can be independently adjusted to control the general contour of the thighs, back, hips and shoulders. Different cushions can be chosen to closely control the patient's orientation and to snugly but comfortably fit him into the adjusted frame. Close fitting of a patient's trunk and the region above the hips, for a wide variety of body types, is enabled by the use of a three-cushioned lower back arrangement, which includes a lower back cushion that supports only the back, and a pair of side cushions located at either side of the back cushion and projecting forward of it to lie on either side of the patient. The modular side cushions are chosen from a group of such cushions, which provide proper lateral positioning and closely fit the person.

7 Claims, 15 Drawing Figures

MODULAR ARTICULATING SEATING SYSTEM FOR THE HANDICAPPED

BACKGROUND OF THE INVENTION

A variety of disabilities necessitates specialized seating for handicapped persons wherein the person, and particularly his torso, must be securely yet comfortably held in a predetermined position. The general orientation of the person varies with different illnesses. For example, persons with muscular dystrophy may have to be held in an exaggerated lumbar lordosis position, persons with cerebral palsy may have to be held with their shoulders and back rounded forward and their head directly over their shoulders, while quadriplegic persons may have to be held with their back and head extending in a straight line but at an extreme rearward incline. Close support of the person's trunk, not only at the front and back but on either side, requires that the seat be formed to accommodate persons of various widths at different parts of their body. Heretofore, the seats available to persons were either of moderate cost with no or poor fitting capability, or well-fitting but individually hand shaped and of a very high cost. Seats available at moderate prices have utilized primarily flat or gently curved surfaces that could accommodate all persons but none of them comfortably or closely. Some seats have provided cushions mounted on movable supports with many degrees of freedom, but such supports tended to loosen, and the cushions could not adequately fit a wide area of persons of different shapes. No existing seats allow for the body to be rounded or for proper contouring of patients with hip and spinal obliquities (non-symmetrical growth). Custom seats were available, which were individually cut to fit or were molded to the person by using a hardenable molding compound and molding one or a few cushion sections to the person such as by casting around him. Such custom seats require considerable time of the person and of skilled technicians, resulting in a high cost. Such custom molded seats have been especially expensive when utilized for children, whose dimensions greatly change perhaps after periods of less than a year, as they grow, requiring a new customized seat.

A seating system which could adjust to and hold a patient in any of a variety of general position orientations, and which also could comfortably but securely hold a patient in a particular position within that orientation, which could be quickly fitted to a patient utilizing off-the-shelf parts, and which could be refitted at moderately low cost to growing children, would have considerable benefit to handicapped persons.

SUMMARY OF THE INVENTION

In accordance with one embodiment of the present invention, a seating system is provided for handicapped persons, which can be readily fitted to a patient to closely and comfortably support him in an orthopedically correct orientation, utilizing a limited number of off-the-shelf parts to enable fitting at low cost. The seat includes a shell-like frame having a seat bottom and back that can be locked within a range of pivotal positions with respect to the seat bottom. A group of cushions can be readily installed on the seat frame, and the cushions are orthopedically designed for specific disabilities and to closely hold a particular individual. The cushions include a lower back cushion that supports only the lower back of a patient. Pairs of side cushions, which position the patient laterally, are mounted on either side of the lower back cushion and extend forward of it to closely support and flex the patient. Side cushions of various thicknesses are available, which all can be utilized independently with the same lower back cushion, to accommodate lateral deformity and variations in patients width.

The seat back includes an upper shell segment which is pivotally mounted to a lower shell segment, to permit choice of the degree of vertical curvature to which the back of a patient is held. All shell segments can be not only pivotally adjusted, but also can be adjusted to permit limited vertical or horizontal sliding, to fit persons of varying back height and thigh length. The ability to independently adjust both right and left shoulder and hip positions, allows for correct positioning of patients with spinal deformity or asymmetrical growth patterns.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
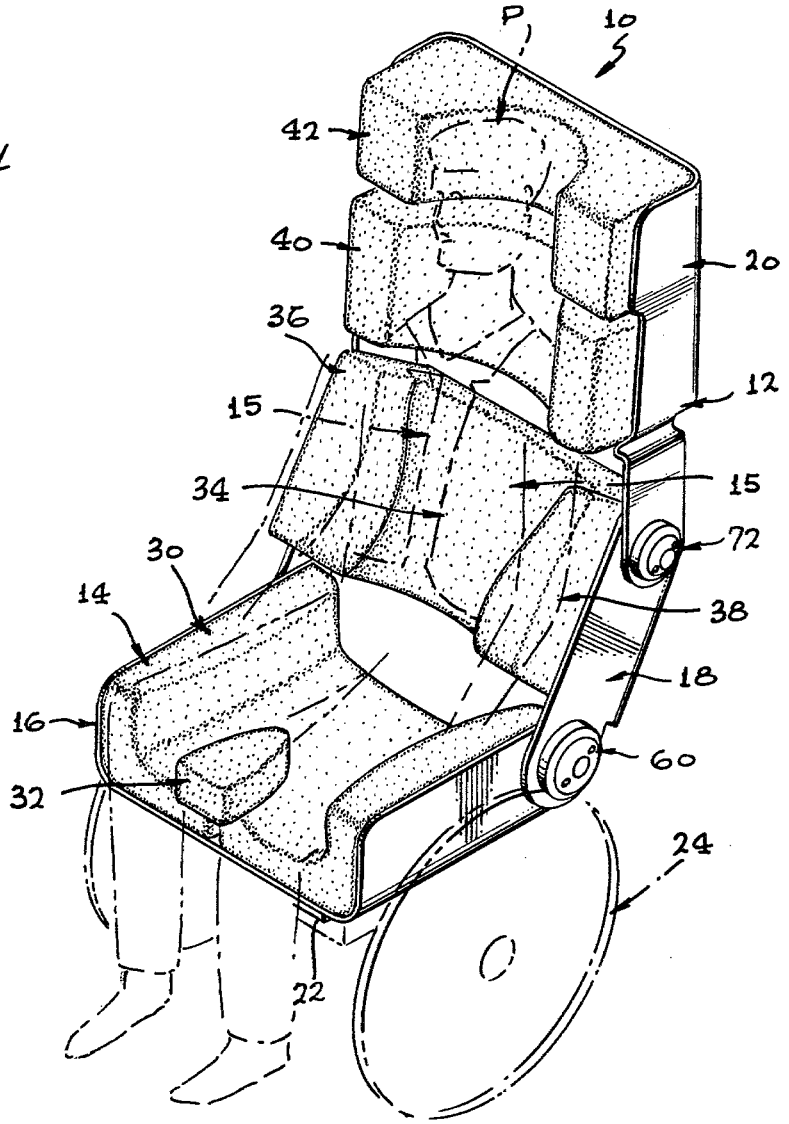
FIG. 1 is a perspective view of a seating system constructed in accordance with one embodiment of the present invention.

FIG. 1 illustrates a seat 10 designed to hold a handicapped person very securely and comfortably in a predetermined upright position. The seat includes a shell-like frame 12 and a group of cushions 14 mounted on the frame and closely fitted to the person. A harness 15 extends in front of the person's trunk to hold him in place. The frame 12 includes a seat bottom frame member or shell 16 and a seat back which includes a lower seat back frame member or shell 18 and an upper seat back frame member or shell 20, all of which are adjustably positioned with respect to one another to determine the general configuraiton of the seat. A mounting base 22 fitted to the bottom of the seat frame bottom 16, enables the seat to be mounted on a variety of devices such as the wheelchair base indicated at 24, on a special car seat holder, or merely positioned on a car seat with the seat held in place with straps.

The cushion arrangement 14 includes several orthopedically contoured cushions that can be easily mounted and removed to fit the seat to a particular individual at a particular desired orientation for that individual. The cushion system includes a seat bottom cushion 30 that supports most of the weight of the person, an abductor or thigh cushion 32 for holding the thighs of a person, a lower seat back cushion 34 for supporting the lower back, a pair of waist level side cushions 36, 38 lying on either side of the lower seat back cushion to closely support opposite sides of the trunk of the person at his waist, a shoulder cushion 40 designed to support the shoulder portion of the person, and a head cushion 42 designed to closely support the head of the person. The cushions are held in place by hook and loop type fastener pads, such as the type sold under the Velcro trademark, or interfitting post-type fasteners such as the Headlock fastener sold by the 3M Company, to enable the cushions to be easily fastened in place at any chosen position on the frame.

Figure 2:
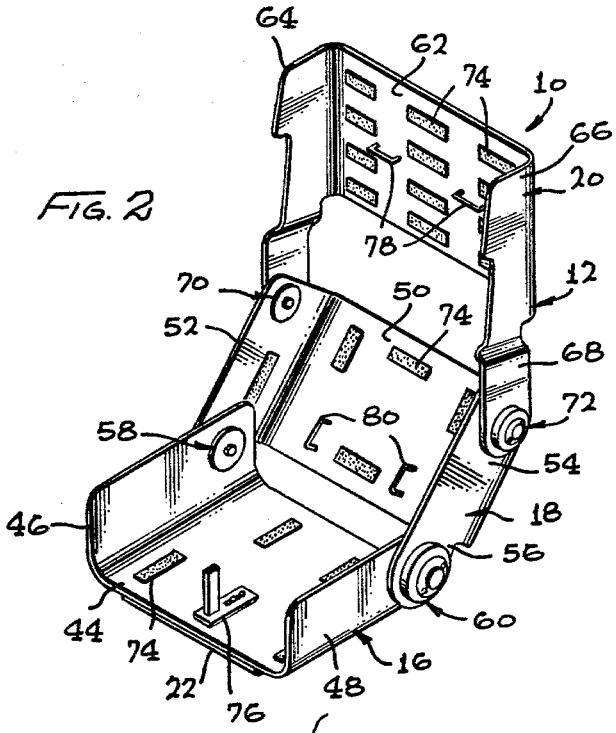
FIG. 2 is a perspective view of the frame of the seating system of FIG. 1.
Figure 7:
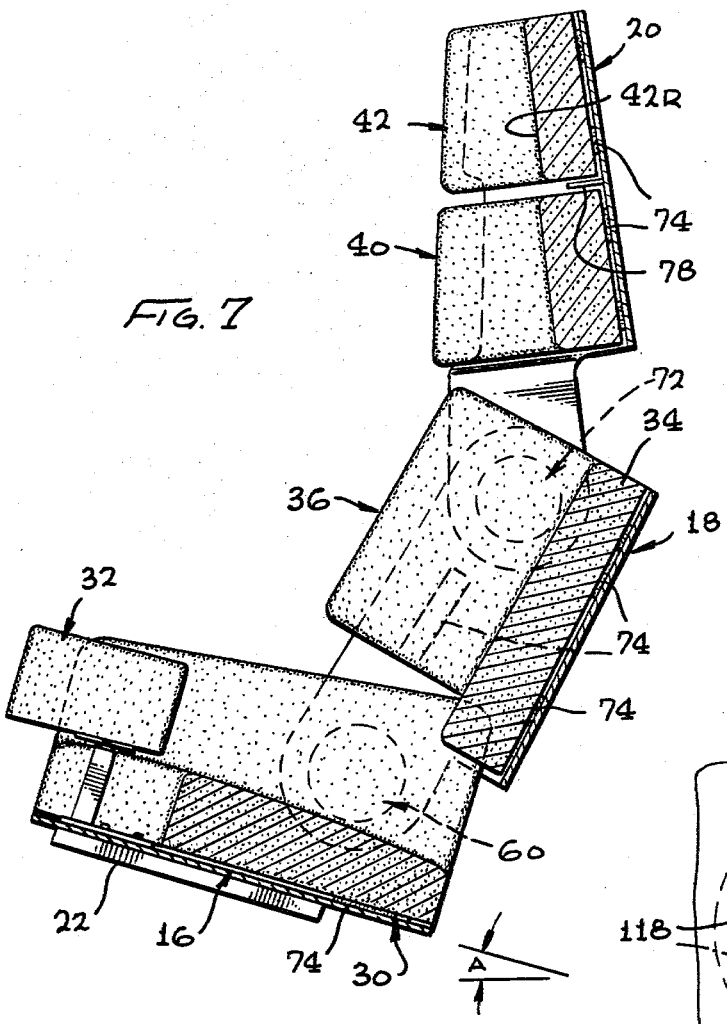
FIG. 7 is a view taken on the line 7—7 of FIG. 6.

As shown in FIG. 2, the three frame members 16, 18 and 20 can be constructed of reinforced plastic plates formed to the illustrated shape. The seat bottom member 16 is of a U-shaped form, with a base 44 lying in a largely horizontal plane and a pair of upstanding plate-like legs 46, 48 lying in largely vertical planes at opposite side of the base. It may be noted that the base 44 is typically utilized by tilting it backwardly (by an angle A shown in FIG. 7) by an amount such as 15°, to more securely hold the person in the seat. The frame lower back member 18 is also of a substantially U-shaped configuration, with a lower back base 50 lying above the rear of the seat bottom base 44, and having a pair of outstanding legs 52, 54 extending largely forwardly on either side of the lower back base and lying in largely horizontal planes. Each of the legs 52, 54 of the lower seat member has a downwardly-extending flange 56 which is connected by a joint 58, 60 to a corresponding one of the seat bottom legs 46, 48. As will be described below, the joints 58, 60 permit pivoting of the lower seat back with respect to the seat bottom, and also permits a degree of shifting in any direction such as up and down to increase or decrease the height of the lower seat back. The upper seat back frame member 20 is also of a largely U-shaped configuration, with a base 62 lying over the lower seat base 50, and with a pair of largely forwardly-extending legs 64, 66. The legs 64, 66 have downwardly-extending flanges 68 that are pivotally connected at joints 70, 72 to the lower seat back legs 52, 54. A considerable gap is left between the lower and upper bases 50, 62 to permit ventilation and to enable pivoting without interference. Thus, the frame has a seat bottom formed by the bottom member base 44, a seat back formed by the back member bases 50, 62, and side walls formed in part by the legs 46, 48, 52, and 54.

Figure 4:
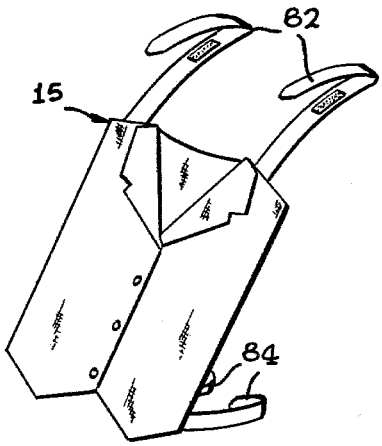
FIG. 4 is a partial perspective view showing a harness which can be utilized with the seating system of FIG. 1.

The frame 12 includes a group of hook-and-loop type fastener pads 74 positioned to receive the various cushions. A thigh cushion mounting bracket 76 is mounted at the middle of the seat bottom 16, and can be adjusted forwardly or rearwardly to hold the thigh cushion in a selected position. A pair of upper harness fittings 78 and a pair of lower harness fittings 80, enable the mounting of the harness on the seat. As shown in FIG. 4, the harness 15 includes a pair of upper straps 82 that can fit through the upper harness fittings, and a pair of lower straps 84 that can fit through the lower harness fittings to hold a patient snugly against cushions on the frame.

Figure 3:
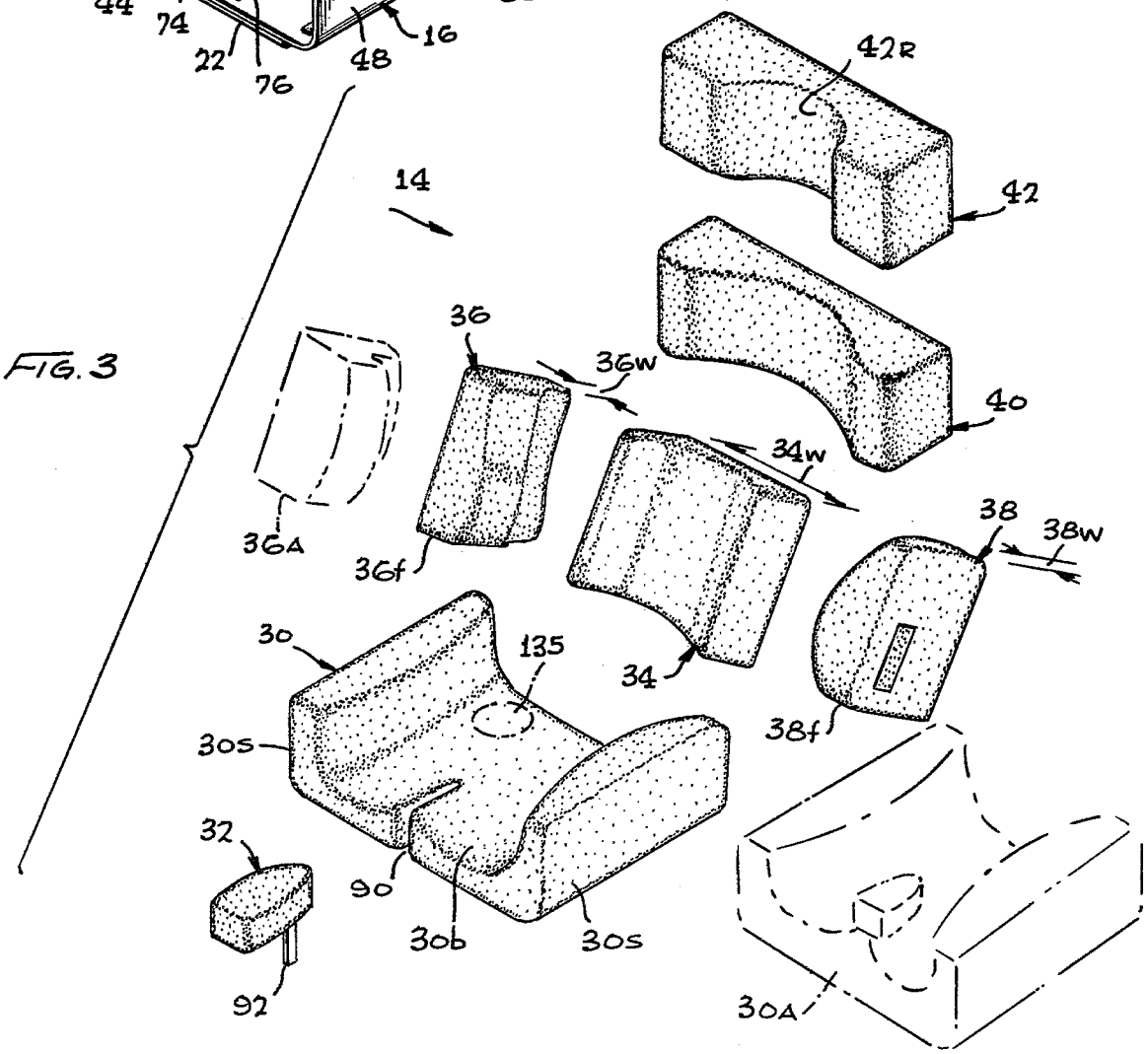
FIG. 3 is a perspective view of the cushion system utilized with the frame of FIG. 1.

FIG. 3 illustrates the group of cushions 14 that are utilized on the seat frame to hold a patient snugly in position. One of the most important considerations in designing the cushions for a handicapped seating arrangement, is to provide close support for the trunk of the person near waist level. This can be accomplished by utilizing cushions that fit closely against opposite sides of the person's waist region, but the great variability in the width of persons' waists has heretofore made this fitting difficult. To accomplish such fitting, a three cushion arrangement is provided, which includes a lower back cushion 34 that is designed only to support the back of a person, and two separate side waist cushions 36, 38 that engage only the side of the person near his waist.

Figure 8:
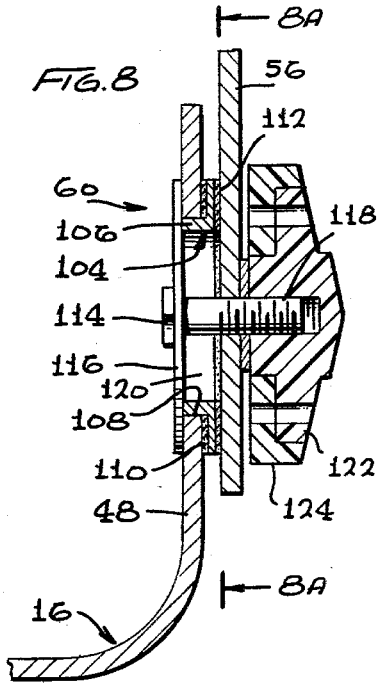
FIG. 8 is a view taken on the line 8—8 of FIG. 5.

The cushions 34, 36 and 38 are formed, as shown in FIGS. 3 and 8, so that the width **34*w* of the back cushion and the widths 36*w* and 38*w* of the rearward side cushion portions fit snugly in the U-shaped lower back frame member 18, to stabilize the positions of these cushions. The forward portion 36*f*, 38*f* of the side cushions can be constructed to any width within a wide range to closely confine the sides of the person. A young and thin person can be seated by the use of side cushions which have wide forward portions 36*f*, 38*f*. As that child becomes older and wider at the waist, the side cushions can be replaced by others of a somewhat smaller width at their forward portion, such as side cushion 36A, to closely fit the person. For a person with narrow hips and chest, a relatively straight cushion may be utilized, while for a person with a narrower waist but wider hips and chest, a more curved side cushion may be utilized. For persons with lordosis, a thicker lower back cushion 34 may be utilized, while for persons who have a form of sclerosis which requires a sideward tilting of the trunk, one side cushion may be thicker than the other. The side cushions 36, 38** extend forwardly so as to engage the sides of the person at his waist, but not so far as to interfere with the person's arms extending down in front of the side cushions and with his forearms lying on the side portions of the bottom cushion. Alternate head and shoulder cushions of different counters also are available.

The bottom cushion 30 shown in FIG. 3 is a single-trough-shaped number with a bottom **30*b* and upstanding sides 30*s*. However, a separate bottom and separate side cushions can be utilized to facilitate fitting to a wider range of persons, or a different combined bottom cushion 30A can be provided. It may be noted that the bottom cushion has a slot 90 which receives a mounting bar 92 on the thigh cushion 32 to facilitate the mounting of the thigh cushion on the mounting bracket 76 of the frame. The uppermost or head cushion 42 is formed with a deep recess 42R to closely surround the head of a person, to help keep it in a centered position. The shoulder cushion 40 normally can be constructed with a shallower recess. Cushion 135** is an optional cushion to accommodate growth asymmetries.

Figure 5:
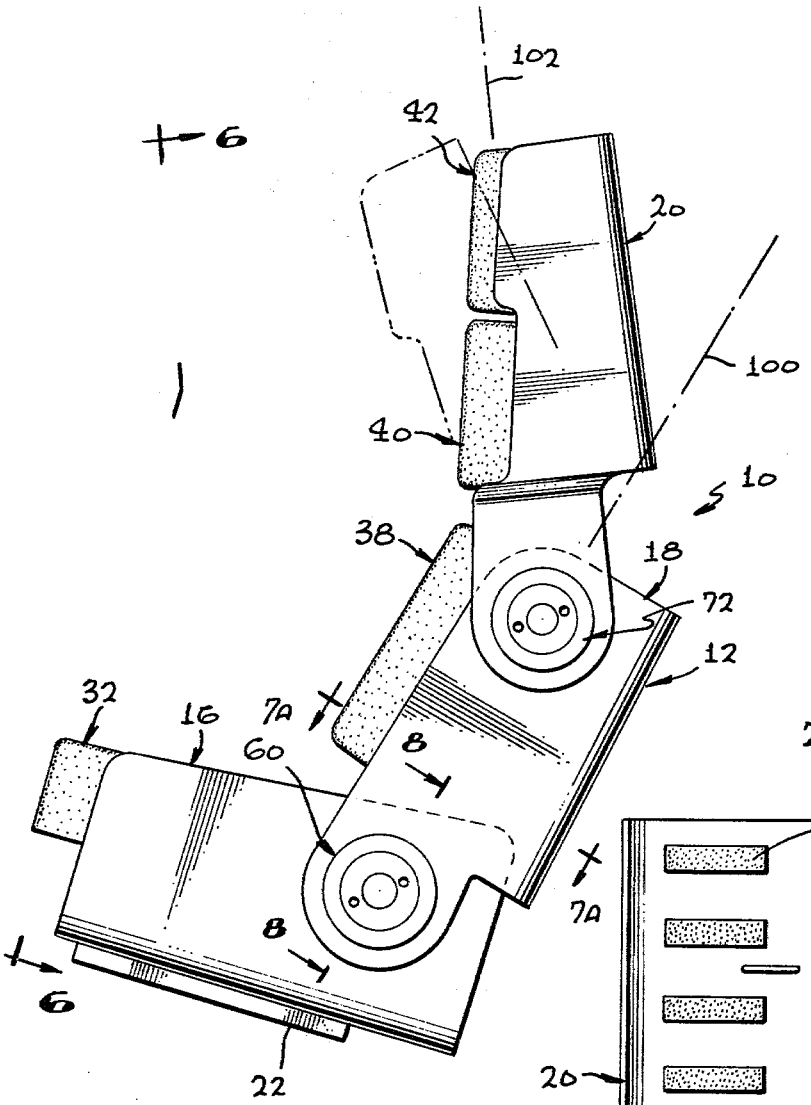
FIG. 5 is a side elevation view of the seating system of FIG. 1.
Figure 6:
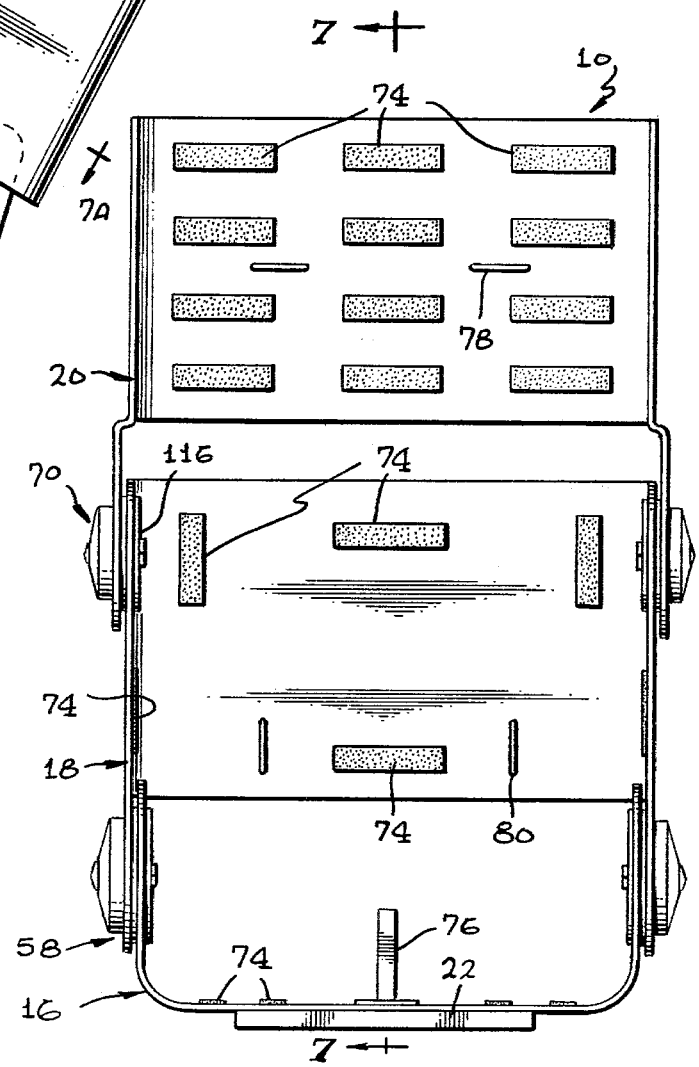
FIG. 6 is a view taken on the line 6—6 of FIG. 5.

In fitting a seat to a handicapped person, a technician can first adjust the relative positions of the three frame members 16, 18, and 20 (FIG. 5). Each of the joints such as 60 and 72 permit pivoting of the frame members to choose a variety of general seat configurations. For example, in cerebral palsy, it is generally desirable to round the back of the person, which can be accomplished by pivoting the upper back member 20 from the orientation along a straight back line 100 to a forward-tilted arc 102. In a typical seating arrangement for cerebral palsied individuals, an upright trunk orientation may be desirable, in which case the upper frame back portion 20 may be oriented upright along the line 100. The joint such as 72 which connects the upper and lower back frame portion, is a pivot joint that can be locked in a desired orientation.

The lower back frame member 18 is designed not only to be pivoted with respect to the seat bottom 16 and upper back frame member 20 to adjust the angular orientation of the person, but also to enable some adjustment for variation in the height of persons as well as other variations. This is important, for example, in enabling the same frame to be utilized with a child over a period of a few years while he is growing in height and therefore the distance between his waist and seat bottom is increasing. To this end, the joints 58, 60, 70 and 72 are each constructed as shown in FIGS. 8 and 8A, to permit sliding as well as pivoting.

Figure 8A:
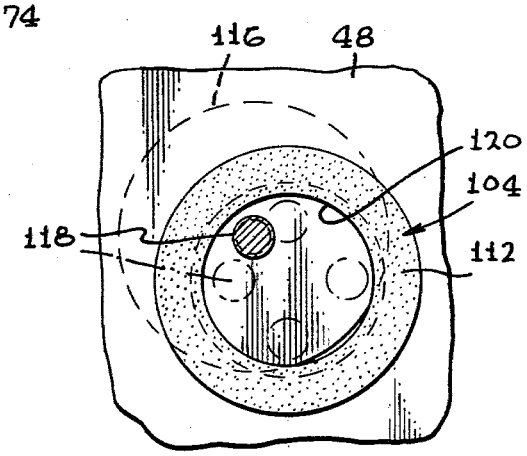
FIG. 8A is a view taken on the line 8A—8A of FIG. 8.
Figure 7A:
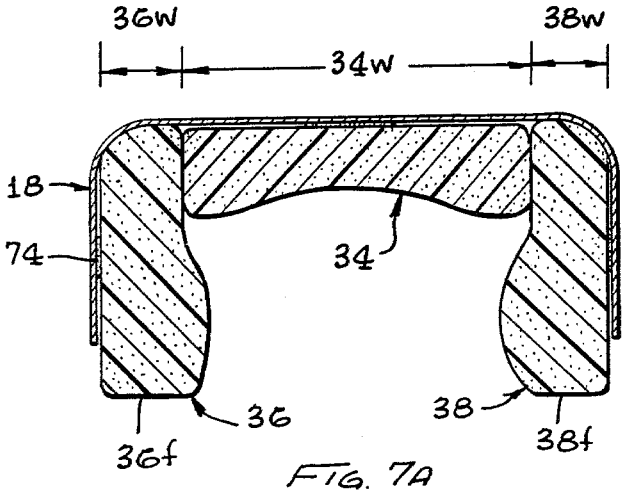
FIG. 7A is a view taken on the line 7A—7A of FIG. 5.

As shown in FIGS. 8 and 8A, the joint 60 includes a special washer device 104 which has a projection 106 that closely fits in a hole 108 formed in the leg 48 of the seat bottom member. The washer device 104 includes a steel ring member and a pair of rubber washers 110, 112 on opposite sides thereof. A locking bolt device 114 includes a large flange 116 that lies against the inner side of the seat bottom leg 48, and a bolt 118 that passes through a large hole 120 in the washer device 104 and threadably engages a nut 122. The nut 122 is of specialized construction, to closely fit in a sleeve 124 when fully threaded into position, so that the sleeve 124 can prevent unauthorized turning of the nut 122 by a person without a specialized tool that fits into a pair of holes in the nut. When the nut 122 is loosened slightly, it not only permits the flange 56 of the lower back frame member to pivot, but also permits it to shift up or down, by shifting of the bolt 118 within the hole 120. Such shifting permits some lengthening or shortening of the frame, to accommodate growing of a child or to obtain a somewhat better fit to a person. The joint also allows forward and rearward shifting of the lower back member 18 with respect to the seat bottom and upper back member. In certain disabilities, such as obliquity of the spine, a person trunk may have to be held in a slightly rotated position, which can be accomplished by moving one joint such as 58 forward, and the opposite joint 60 rearwardly.

Figure 9:
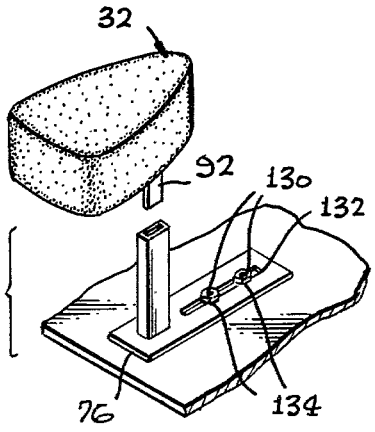
FIG. 9 is a partial perspective view of the seating system of FIG. 1, showing details of the thigh cushion-holding arrangement.

FIG. 9 shows the manner in which the thigh cushion 32 can be installed by its rod 92 fitting into the mounting bracket 76. The mounting bracket 76 is mounted by a pair of bolts 130 that fit through holes in the seat bottom member and through a slot 132 in the bracket. The bracket 76 can be slide forward or rearwardly, and a pair of nuts 134 tightened on the bolts 130 to fix the position of the bracket.

Figure 11:
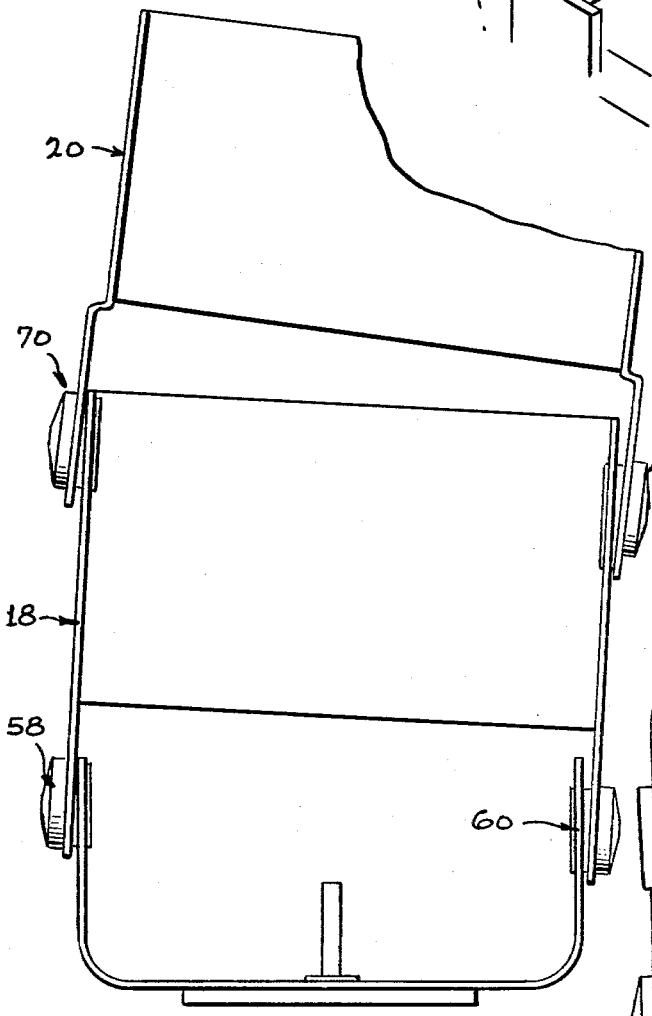
FIGS. 11–13 shows the frame of the seating system of FIG. 1 in various configurations.
Figure 13:
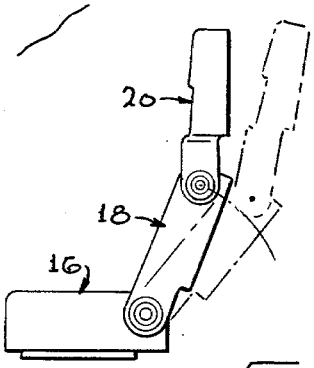
Figure 12:
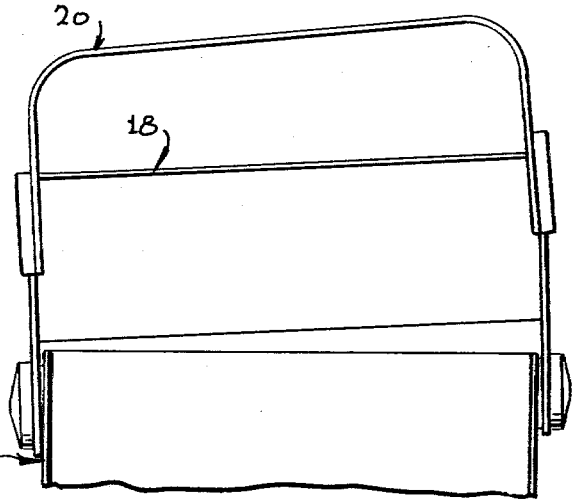

FIGS. 11–13 show the seat in additional positions that are appropriate for various conditions. FIG. 11 shows the lower seat back shell 18 tilted to one side at the hip joints 58, 60, and the upper seat back shell 20 also tilted to one side at the shoulder joints 70, 72, to meet a patient's lateral assymetric deformity. In that case, an auxiliary bottom cushion (shown at 135 in FIG. 3) may be utilized. FIG. 12 shows the lower and upper shells 18, 20 twisted about a vertical axis, by lateral shifting of the joints 58, 60, 70 and 72, to meet a patient's hip and spine rotational misalignment. FIG. 13 shows a range of positions of pivoting and sliding of the shell portions, to accommodate a variety of lengths and contours of patients.

Figure 10:
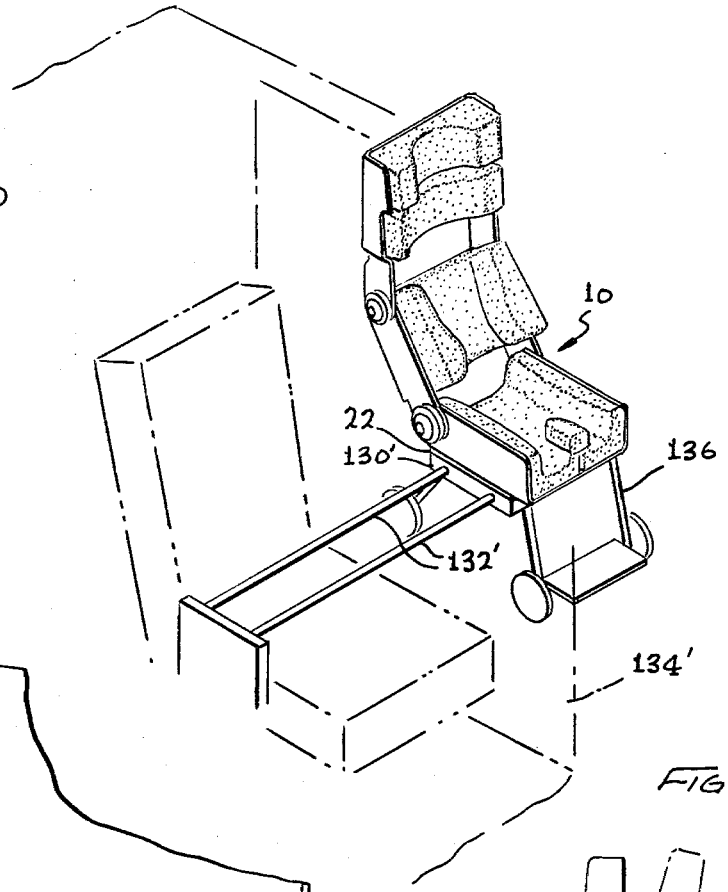
FIG. 10 is a partial perspective view of a transfer conveyor system constructed in accordance with another embodiment of the invention, which utilizes the seat of FIG. 1.

The seat 10 with a mounting base 22 thereon, facilitates multiple uses of the seat. Disabled persons normally are transferred to an automobile by removing them from a wheelchair and carrying them into the auto. By utilizing the seat 10 as the seat portion of both a wheelchair and a seat portion of an automobile, and by providing a transference conveyer, the handicapped person can remain in the same seat 10 during both wheelchair and automobile travel. Such transference of seat is useful both in aiding a handicapped driver to move himself into or out of the driver's seat of an auto, and in aiding the transference of a large child or adult to the passenger seat. FIG. 10 shows a conveyor adapter 130' held on the mounting base 22, and slideable along a pair of rods 132' extending from an automobile 134'. The adapter 130' has been disengaged from a wheelchair base 136 and has received the rods 132', to begin the transference into the automobile.

Thus, the invention provides a seating system for the handicapped, which enables close support of a person, particularly at the trunk, in a custom designed manner, but without the large cost and time normally required for custom fitting. This can be accomplished by the use of a frame that permits adjustment of the general configuration of the seat, such as the relative angular positions of the seat bottom to the lower seat back, the lower and upper seat backs, and the limited adjustment of the height of the seat back over the seat bottom. In addition, separate easily installed cushions are provided that permit close fitting of the seat to a particular patient. The trunk of the patient, particularly at the waist, can be closely and comfortably encircled by a lower back cushion at the rear, a harness at the front, and a pair of side cushions at either side. Close fitting to the patient is achieved by choosing side cushions of proper thickness for that particular patient, and if the patient's waist increases as in the case of a growing child, the side cushions can be replaced by somewhat narrower ones to maintain the close support. By the use of a relatively limited number of different frame and cushion sizes, handicapped persons of a wide variety of sizes and required positions can be closely fitted at a relatively low cost. A technician fitting a particular person has to spend some time to choose the proper orientations of the frame members and to choose the proper cushions and install them, but the time is much less than has been required heretofore in custom fitting.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A seating system for handicapped persons comprising:

a seat bottom shell;

a lower back shell;

an upper back shell;

a pair of first joint means coupling said lower back shell to said seat bottom shell, for permitting both pivoting and sliding of said lower back shell with respect to said seat bottom shell; and a pair of second joint means coupling said upper and lower back shells, for permitting both pivoting and sliding of said back shells with respect to each other; and locking at a plurality of relative positions permitted by such pivoting and sliding.

2. The system described in claim 1 wherein:

each of said first joints can be shifted laterally with respect to one another, and each of said second joints can be shifted laterally independently of one another, whereby to enable the seat to accommodate rotational misalignment of a patient.

3. A seating system for handicapped persons, comprising:

a seat frame forming a seat bottom and a seat back, and having frame side walls and inner surfaces; and a plurality of cushions, including a back cushion, a pair of side cushions, and a seat bottom cushion mountable on said seat frame, at least said side cushions including detachable fasteners detachably fastenable to the sides of the frame at the inner surfaces thereof;

said seat back of said frame including a lower seat back portion pivotably joined to said frame seat bottom and lockable in different pivoted positions thereto, and an upper seat back portion pivotably joined to said lower seat back portion and lockable in different pivoted positions thereto.

4. The system described in claim 3 wherein:

one of said seat back portions includes a pair of flanges on either side thereof and extending beyond and pivotably connected to the other seat back portion, to leave a gap along most of the width of the seat back between the back portions to permit considerable pivoting and ventilation.

5. A seating system for handicapped persons, comprising:

a seat frame forming a seat bottom and a seat back, and having frame side walls and inner surfaces; and a plurality of cushions, including a back cushion, a pair of side cushions, and a seat bottom cushion mountable on said seat frame, at least said side cushions including detachable fasteners detachably fastenable to the sides of the frame at the inner surfaces thereof;

said seat back of said frame including a lower seat back portion pivotable, and with the pivot axis moveable, with respect to said frame seat bottom and lockable in positions different in position of the pivot axis and in the angular position about the pivot axis with respect to said frame seat bottom.

6. A seating system for handicapped persons comprising:

a seat frame which includes a seat bottom, a lower seat back, and an upper seat back;

a plurality of pads of hook-loop type fastener material mounted on the inner surfaces of said frame;

a plurality of cushions mounted on said frame;

said seat bottom comprising a substantially U-shaped member with a base lying in a largely horizontal plane and a pair of upstanding walls lying in largely vertical planes at opposite sides of the base;

said lower seat back comprising a substantially U-shaped member with a back base lying above the rear of said seat bottom base and a pair of outstanding walls extending largely forwardly on either side of the back base and lying in largely planes, each seat bottom upstanding wall connected to a corresponding seat back wall in a pivotable joint that can be locked at a plurality of pivotal positions;

said plurality of cushions having pads of hook-loop type fastener material attachable to said pads on said frame; and said cushions including a lower seat back cushion having a width less than the width of the lower back base, and a pair of side cushions, said lower seat back cushion and side cushions together fitting closely between the walls of the lower seat back member, and said side cushions projecting forward of the lower seat back cushion.

7. A seating system for handicapped persons comprising:

a seat frame which includes a seat bottom, a lower seat back, and an upper seat back; and a plurality of cushions mounted on said frame;

said seat bottom comprising a substantially U-shaped member with a base lying in a largely horizontal plane and a pair of upstanding walls lying in largely vertical planes at opposite sides of the base;

said lower seat back comprising a substantially U-shaped member with a back base lying above the rear of said seat bottom base and a pair of outstanding walls extending largely forwardly on either side of the back base and lying in largely horizontal planes, each seat bottom wall connected to a corresponding seat back wall in a pivotable joint that can be locked at a plurality of pivotal positions;

said walls of said seat bottom member and of said lower seat back member, each have holes; and including a pair of bolts, each extending through a pair of holes in the member walls on one side of the chair; and a pair of nuts tightenable on the bolts;

one of the holes lying on each side of the chair being a plurality of times wider than the bolt, to permit relative sliding as well as pivoting of the bottom and back members.

* * * * *